United States Patent [19]

Kusunoki

[11] Patent Number: 4,979,344

[45] Date of Patent: Dec. 25, 1990

[54] FABRICATED STONE PANEL UNIT AND MOUNTING STRUCTURE THEREOF

[75] Inventor: Toshimasa Kusunoki, Chiba, Japan

[73] Assignee: Yoshida Kogyo K.K., Tokyo, Japan

[21] Appl. No.: 316,655

[22] Filed: Feb. 28, 1989

[30] Foreign Application Priority Data

Mar. 2, 1988 [JP] Japan ..... 63-26887[U]

[51] Int. Cl.[5] ..... E04B 2/96

[52] U.S. Cl. ..... 52/235

[58] Field of Search ..... 52/235, 475, 396, 397, 52/403

[56] References Cited

U.S. PATENT DOCUMENTS

| | | | |
|---|---|---|---|
| 3,110,131 | 11/1963 | Jeffress | 52/235 X |
| 4,060,951 | 12/1977 | Gere | 52/235 X |
| 4,571,905 | 2/1986 | Kaminaga | 52/235 |
| 4,625,481 | 12/1986 | Crandell | 52/235 |
| 4,837,999 | 6/1989 | Eckelt | 52/235 |

FOREIGN PATENT DOCUMENTS

| | | | |
|---|---|---|---|
| 379186 | 11/1985 | Austria | 52/235 |

*Primary Examiner*—Richard E. Chilcot, Jr.

[57] ABSTRACT

A stone panel unit including: a frame member formed by connecting, in a rectangular shape, an upper transverse frame member, a lower transverse frame member having an outwardly and horizontally projecting stone panel resting piece formed integrally at the lower end thereof, and one set of left and right vertical frame members spaced away at intervals of a predetermined distance; at least one stone plate adhesively bonded onto the outer surface of the frame so that it may be supported on the frame by allowing the lower end thereof to rest on the stone plate resting piece; and at least one reinforcing face plate mounted substantially on the entire rear surface of the frame. The panel unit further includes at least an intermediate transverse frame member disposed substantially horizontally by butt-jointing both ends thereof to the set of left and right vertical frame members, respectively, between the upper and lower transverse frame members and having an outwardly and horizontally projecting stone plate resting piece formed integrally therewith. The panel unit is mounted by such a mounting structure as allowing the unit at the time of mounting it to be adjusted in its position in the transverse direction in parallel with the panel surface and in the direction at right angles to the panel surface.

4 Claims, 6 Drawing Sheets

FABRICATED STONE PANEL UNIT AND MOUNTING STRUCTURE THEREOF

BACKGROUND OF THE INVENTION

1. Field of the Invention

This invention relates to a stone panel unit for use as an external wall member of architecture such as buildings, etc., and a mounting structure thereof, and more particularly to a fabricated stone panel unit which can effect reduction in weight, saving in building cost, shortening of manufacturing time to be achieved, etc., and a fabricated stone panel mounting structure whereby the creation of clearance between structural members can be prevented by mounting the stone panel units in such a manner that they may be displaced in the transverse direction which is parallel with the panel surface, and also in the direction at right angles to the panel surface and whereby the construction efficiency can be improved.

2. Description of Prior Art

As external wall members adapted to be mounted on the structural members of buildings which consists of slabs, columns and beams, stone panel units comprising stone panels mounted on rectangular frames have recently come to be widely used.

In stone panel units of the kind specified, since the frames tends to deform by the heavy weight of stone panels (referred to simply as stone panels hereinbelow), thick steel frames having a sufficient strength have been used, and also a method of preventing deformation of the frames due to the weight of the stone plates by placing mortar on the rear surface of the frames have been used.

Such stone panel units have very large overall thickness and are heavy in weight thus increasing the thicknesses of the external walls of buildings more than the actual requirements thereby reducing the living spaces inside the buildigns. Further when stone panel units are mounted on the structural members of buildings, not only large cranes need to be used thus impairing the construction efficiency, but also since high stresses are exerted the structural members of buildings, it is required to increase the thicknesses of slabs and dimensions of beams and columns so that they can carry the heavy weight of stone panel units, which results in increased building costs.

Further, because of the need for curing mortar, the stone panel unit manufacturing time is prolonged.

Further, in respect of the structure for mounting stone panel units on the skelton of buildings and the connecting structure between adjoining stone panel units, there are a variety of restrictions due to the heavy weight of stone panel units themselves, and therefore simple and reasonably flexible mounting structures and connecting constructions cannot be used.

SUMMARY OF THE INVENTION

The present invention has been made in view of the above-mentioned circumstances, and has for its object to provide a stone panel unit which is light in weight and comparatively thin in thickness and which can be manufactured in a short time and can reduce the building cost.

Another object of the present invention is to provide a stone panel unit mounting structure wherein the creation of clearance between structural members can be prevented by mounting the stone panel units as set forth in the above-mentioned first object on the skelton of a building so that, at the time of mounting, they may be adjusted in their position in the transverse direction which is parallel with the penel surface and also in the direction at right angles to the panel surface, and whereby the construction efficiency can be improved.

To achieve the above-mentioned first object, according to the first aspect of the present invention, there is provided a stone panel unit comprising:

A stone panel unit comprising: a frame member formed by connecting, in a rectangular shape, an upper transverse frame member, a lower transverse frame member having an outwardly and horizontally projecting stone panel resting piece formed integrally at the lower end thereof, and one set of left and right vertical frame members spaced away at intervals of a predetermined distance; at least one stone plate adhesively bonded onto the outer surface of the frame so that it may be supported on the frame by allowing the lower end thereof to rest on the stone plate resting piece; and at least one reinforcing face plate mounted substantially on the entire rear surface of said frame.

To achieve the above-mentioned second object, according to the second aspect of the present invention, there is provided a stone panel unit mounting structure comprising:

a stone panel unit including a frame formed by connecting, in a rectangular shape, an upper transverse frame member, a lower transverse frame member having an outwardly and horizontally projecting stone plate resting piece formed integrally at the lower end thereof and one set of left and right vertical frame members spaced away at intervals of a predetermined distance;

at least one stone plate adhesively boned onto the outer surface of the frame so that it may be supported on the frame by allowing the lower end thereof to rest on the stone plate resting piece; and at least one reinforcing face plate mounted substantially on the entire rear face of the frame; a plurality of mullion members located transversely on a building at intervals of a predetermined spacing and fixedly secured onto the building wall;

a plurality of upper brackets each having a projection which projects towards the indoor side and in parallel with each of the mullions, the projection having at least one downward recess formed in the approximately central, lower portion thereof, the upper brackets being fixedly secured to the upper parts of the vertical frame members of the stone panel unit by means of a plurality of bolts;

a plurality of supporting rods each engaging with a downward recess of each of the upper brackets in such a manner that, at the time of mounting, the stone panel unit mounted on one set of adjoining mullion members, which are located at intervals of a spacing somewhat wider than the predetermined spacing and each of which projects horizontally and inwardly from each of the mullion members, may be changed in its position in the transverse direction in parallel with the panel surface and in the direction at right angles to the panel surface; and a plurality of L-shaped connecting brackets each having one side piece and the other side piece, the one side piece being fixedly secured to the side wall of each of the mullion members by means of a plurality of bolts, the other side piece being fixedly secured to the lower transverse frame member and upper transverse frame member of one set of vertically adjoining stone panel units by means of a plurality of bolts.

Further, according to the present invention, there is provided a stone panel unit and a mounting structure thereof, characterized in that the stone panel unit as set forth in the first and second aspect comprises further at least one intermediate transverse frame member which is located substantially horizontally by butt-jointing both ends thereof to the set of left and right vertical frame members, respectively, between the upper transverse frame member and the lower transverse frame member, and which has an outwardly and horizontally projecting stone member resting piece formed integrally therewith at the approximately intermediate portion of the outer vertical plate, whereby forming a rectangular frame portion by the intermediate transverse frame member, the upper or lower transverse frame member and the one set of left and right vertical frame members so that a piece of stone plate may be mounted on the frame portion.

According to the stone panel unit and the mounting structure thereof as set forth in the abovementioned aspects, since the strength of the frame for mounting a stone plate can be increased by reinforcing it with the reinforcing face plate, it is possible to prevent deformation of the frame due to the weight of the stone plate without having to increase the thickness of the frame members forming the frame.

Therefore, since there is no need for increasing the thickness of the frame, the thickness of the stone panel unit can be reduced, and so the thickness of the external wall of the building concrened can be reduced thereby making it possible to increase the living space in it. Further, because the weight of the stone panel units can be reduced, they can be lifted easily by means of a small crane and mounted on the structural members of the building thus improving the construction efficiency. Still further, because the structural members of the building need not carry a heavy load, thus eliminating the need for increasing the dimensions of the structural members of the building more than actual requirements and the need for increasing the strength thereof so that the construction cost can be reduced.

Further, because there is no need for placing mortar, the time required for curing the mortar can be eliminated so that the construction work can be completed in a short time.

Furthermore, since the lower part of the stone plate is supported on the stone plate resting piece of the lower transverse frame member or the intermediate transverse frame member, a heavy load is not applied on the adhesively bonded portion between the stone plate and each of the frame members so that there is no possibility of the stone plate being disengaged from the frame thereof.

The above-mentioned and other objects, aspects and advantages of the present invention will become apparent to those skilled in the art by referring to the following description and the accompanying drawings in which a preferred embodiment incorporating the principles of the present invention is shown by way of example only.

DETAILED DESCRIPTION OF PREFERRED EMBODIMENTS

The present invention will now be described in detail below by way of an embodiment thereof with reference to the accompanying drawings.

Figure 1:
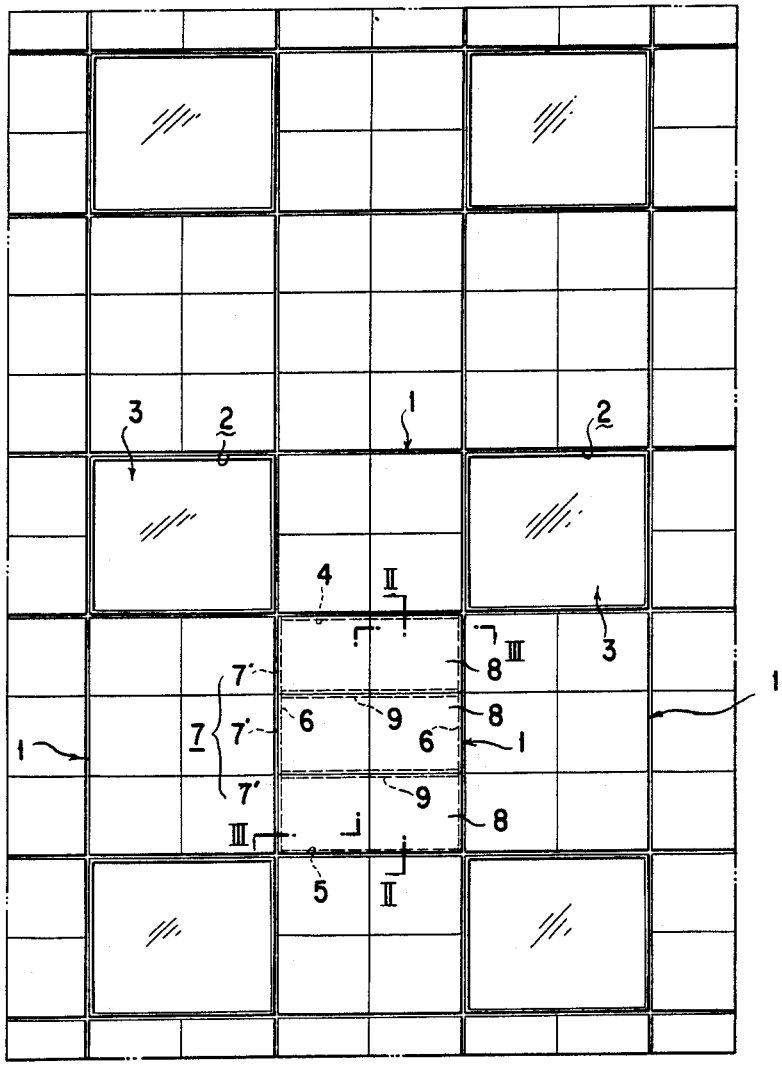
FIG. 1 is a fragmentary, schematic front view of the external wall of a building on which stone panel units of the present invention are mounted.

As shown in FIG. 1, a building, not shown, has, at least on one side surface thereof, a plurality of stone panel units 1 mounted transversely and vertically on the building body, not shown, so as to form openings 2 at a plurality of places, each of the individual openings 2 having a window unit 3 mounted thereon thereby forming the external wall of the building.

Each of the stone panel units 1 has an upper transverse frame member 4, a lower transverse frame member 5, and a pair of left and right vertical frame members 6 and 6, a frame 7 formed by connecting the frame members 4, 5, 6 and 6 in a rectangular shape, has at least one stone plate 8 mounted thereon.

In the embodiment shown in the drawing, provided between the upper and lower transverse frame members 4 and 5 are two intermediate transverse frame members 9 and 9 which are connected to the left and right vertical frame members 6 and 6. A piece of frame 7 is formed by three pieces of the rectangular frame portions 7'. Each of the rectangular frame portions 7' has a stone plate 8 mounted thereon.

Figure 2:
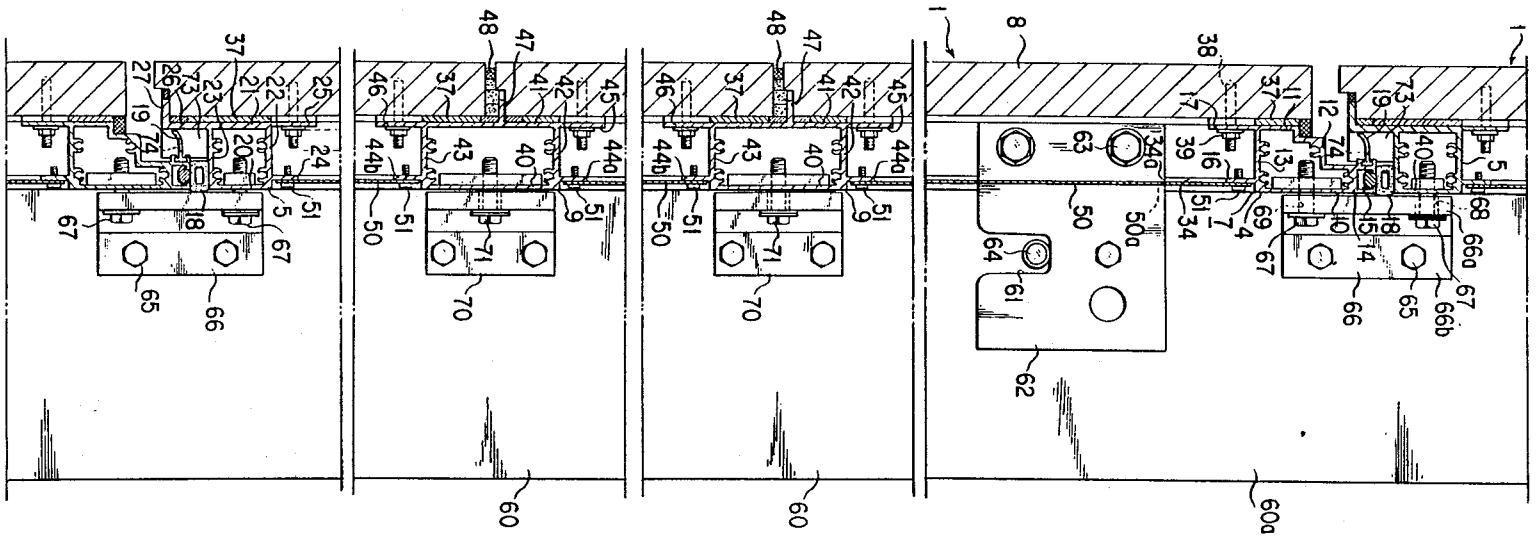
FIGS. 2 and are fragmentary, sectional views taken along lines II—II and III—III, respectively, in FIG. 1.

The upper transverse frame member 4 has an indoor side vertical plate 10 and an outdoor side vertical plate 11, as shown in FIG. 2. The upper ends of both the vertical plates 10 and 11 are integrally connected by a stepped upper plate 12, whilst a lower plate 13 extending horizontally from the approximately intermediate portion of the outdoor side vertical plate 11 to the lower end of the indoor side vertical plate 10 is integrally connected. Thus, the upper transverse frame member 4 is formed as a long hollow member having an approximately key shape in section. Further, the upper plate 12 has an inner upward projection 14 having an upward groove 15 formed in the upper part thereof on the indoor side. Whilst, the lower plate 13 has a downward piece 16 and a hanging-down piece 17 formed integrally therewith at the inner and outer ends thereof, respectively. The outside surface of the hanging-down piece 17 is flush with that of the outdoor side vertical plate 11. The upward groove 15 has an upper transverse AT member 18 mounted thereon, and an upper transverse sealing piece 19 is mounted on the outer surface of the inner upward projection 17 so as to project towards the outdoor side.

The lower transverse frame member 5 has an indoor side vertical plate 21 and an outdoor side vertical plate 21, as shown in FIG. 2. The upper and lower ends of both the vertical plates 20 and 21 are integrally connected by an upper plate 22 and a lower plate 23, respectively. Thus, the lower transverse frame member 5 is formed as a long hollow member having an approximately rectangular shape. The upper plate 22 has an upward projection piece 24 and a rising piece 25 formed integrally therewith at the inner and outer ends thereof, respectively. Whilst, the lower plate 23 has a hanging-down piece 26 formed integrally therewith at the outer end thereof. The hanging-down piece 26 has a stone plate resting piece 27 which is formed integrally therewith at the lower end thereof and which extends horizontally towards the outdoor side. And, the outside surfaces of the above-mentioned rising piece 25 and hanging-down piece 26 are flush with the outer surface of the outer vertical plate 21.

Figure 3:
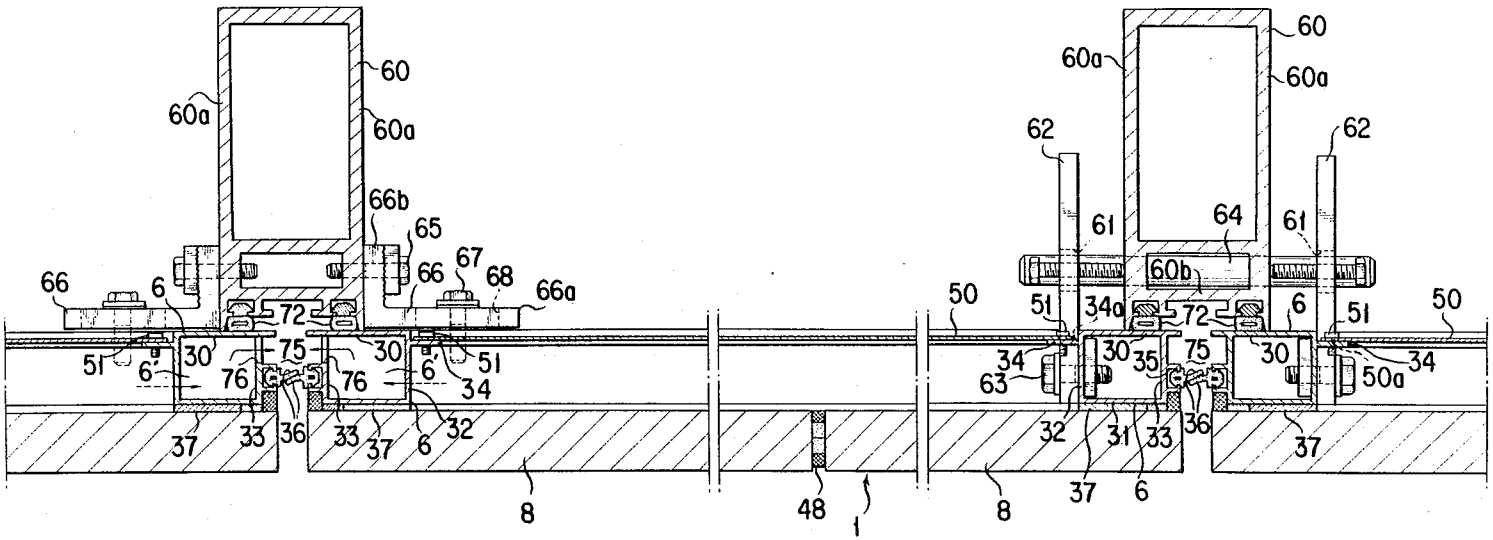

As shown in FIG. 3, each vertical plate member 6 is formed, as a long hollow member having an approximately rectangular sectional shape, by an indoor side vertical plate 30, an outdoor side vertical plate 31, an inner plate 32 and an outer plate 33. The inner plate 32 has an inward projection 34 formed integrally therewith at the inner end thereof and which extends in parallel with the surface of the panel. The outer plate 33 has a groove 35 which is formed in the outer surface thereof and which has a vertical fin-shaped piece 36 fitted therein so as to project outwardly.

The upper part of each vertical frame member 6 is formed in a stepped shape which is the same as that of the upper plate 12 of the upper transverse frame member 4, and the upper and lower transverse frame members 4 and 5 are butt-jointed to the inner plates 32, 32 of a pair of left and right vertical frame members 6, 6.

Thus, on the inside of the frame 7, the downward piece 16 of the upper transverse frame member 4, the upward projection piece 24 of the lower transverse frame member 5 and the inward pieces 34, 34 of one set of left and right vertical frame members 6, 6 are peripherally connected so that the inner surfaces thereof can be located flush with one another, and at least one sheet of reinforcing face plate 50 is mounted on the peripheral inner surfaces by means of a plurality of screws 51.

And, a stone plate 8 is bonded by means of an adhesive 37 to the outer surface of the outerdoor side vertical members 11, 21 of the upper and lower transverse frame members, and one set of left and right outdoor side vertical plates 31, 31. The lower end surface of the stone plate 8 rests on the upper surface of the stone plate resting piece 27, and is fixedly secured to the hanging-down piece 17 of the upper transverse frame member 4 and the rising piece 25 of the lower transverse frame member 25 by means of a plurality of stud bolts 38 fixedly secured to the stone plate 18 and a plurality of nuts 39 threadably engaged therewith.

According to the stone panel unit 1 of the present invention, as described in detail hereinabove, since the strength of the frame 7 is increased by the provision of the reinforcing face plate 50, even if the sizes of the upper and lower transverse frame members 4, 5 and the pair of left and right vertical frame members 6, 6 are reduced, the frame 7 is not deformed by the weight of the stone plate 8. Further, since the stone plate 8 rests on the stone resting piece 27 of the lower transverse frame member 5, no high stress is applied on the adhesively bonded portions, and therefore it is possible to prevent the stone plate 8 from detaching from the frame 7.

Further, as shown in FIG. 2, the intermediate transverse frame members 9 in the embodiment shown is formed in an approximately rectangular hollow shape by an indoor side vertical plate 40, an outdoor side vertical plate 41, an upper plate 42, and a lower plate 43. The upper and lower plates 42 and 43 have an upward piece **44*a* and a downward piece 44*b* formed integrally therewith at their respective inner ends. Further, the upper and lower plates 42 and 43 have a rising piece 45 and a hanging-down piece 46 formed integrally therewith at their respective outer ends so that they may be located flush with the outside surface of the outdoor side longitudinal plate 41. Further, the outdoor side vertical plate 41 has a stone plate resting piece 47 formed integrally therewith so as to project horizontally towards the outdoor side. The thus formed intermediate transverse frame members 9 are butt-jointed to the inner plates 32, 32 of the left and right vertical frame members 6, 6 thereby forming a plurality of rectangular frame portion 7'. Each of the rectangular frame portions 7' has the stone plate 8 and the reinforcing face plate 50 mounted thereon in the same manner as mentioned above. A sealing member 48 is mounted at a position between the adjoining stone plates 8, 8** so that it may fulfil sealing function.

Next, the structure for mounting the stone panel unit 1 on a building body will be described.

As shown in FIGS. 2 and 3, a plurality of mullion members 60 are located horizontally on a building, not shown, at intervals of a spacing which is somewhat wider than the transverse length of the stone panel unit 1, and are fixedly secured to the building body. Mounted on the upper parts of the inner paltes 32, 32 of the left and right vertical frame members 6, 6 of the stone panel unit 1 by mean of a plurality of bolts 63 are upper brackets 62, 62 each having a projection which projects towards the indoor side and in parallel with the side walls **60*a*, 60*a* of each of the adjoining mullion members 60, 60. The projection of each of the upper brackets 62 has at least one downward recess 61 formed in the approximately central, lower part thereof and which is located more indoor side than the indoor side vertical plate 30 of the vertical frame member 6. Supporting rods 64, 64, whose number is at least one on one side, project, respectively, horizontally inwards from the inward side walls 60*a*, 60*a* of each of the two adjacent mullion members 60, 60. The supporting rods 64, 64 are fitted in the downward recesses 61, 61 or the left and right upper brackets 62, 62 with some play therebetween so that, at the time of mounting, the upper part of the stone panel unit 1 can be mounted on the adjoining two mullion members 60, 60 in such a manner that it may be swinged in the transverse direction which is parallel with the panel surface of the stone panel unit 1**, and also it may be adjusted in position in the direction at right angles to the panel surface.

Further, the reinforcing face plate 50 and the inward piece 34 of the vertical frame member 6 have notches **50*a* and 34*a*, respectively, formed therein for positioning the upper bracket 62. Further, in case the intermediate transverse frame members 9 are provided, it is needless to say that the reinforcing face plate 50 and the inward piece 34 are formed additionally with recesses for mounting the frame members 9**.

The lower part of the stone panel unit 1 is mounted together with the upper end of the adjoining lower stone panel unit 1 on one set of adjoining left and right mullion members 60, 60, as described below.

Stating in brief, referring to one mullion member 60, at least one L-shaped vertically connecting bracket 66 has one side piece **66*a* and the other side piece 66*b*, the one side piece 66*a* being mounted on the lower transverse frame member 5 and the upper transverse frame member 4 of one set of adjoining upper and lower stone panel units 1, 1, respectively, by means of a plurality of bolts 7, and the other side piece 66*b* being mounted on the inward side wall 60*a* of the mullion member 60 by means of a plurality of bolts 65. One of the bolts 67 passes through an elongated hole 68 formed in the upper part of one side piece 66*a* of the vertically connecting bracket 66 and is threadably engaged with the indoor side vertical plate 40 of the lower transverse frame member 5, whilst the other bolt 67 passes through a through-hole 69 formed in the lower part of the one side piece 66*a* of the vertically connecting bracket 66 and is threadably engaged with the indoor side vertical plate 10 of the upper transverse frame member 4**.

Further, the stone panel units 1 are mounted on a building body, not shown, in turn, from the lower part thereof to the upper part thereof.

In the next place, weathering of the portions on which the stone panel units are mounted will be described.

A pair of left and right vertical AT members 72, 72 are mounted vertically and outwardly on both the left and right sides of the outdoor side front wall **60*b* of the mullion member 60. The vertical AT members 72 are pressed against the indoor side vertical plates 30 of the vertical frame members 6, and also the upper transverse AT member 18 mounted on the upper transverse frame member 4 is pressed against the lower plate 23 of the lower transverse frame member 5 thereby sealing the clearance between the stone panel unit 1 and the mullion member 60 and the clearance between the vertically adjoining stone panel units 1, 1**.

Whilst, the upper transverse sealing piece 19 mounted on the upper transverse frame member 4 is pressed against the hanging-down piece 26 of the lower transverse frame member 5, as shown in FIG. 2, thereby forming a transverse space 73 between the sealing piece 19 and the above-mentioned upper transverse AT member 18. This transverse space 73 communicates with the outside air via an outside air inlet hole 74 formed in the upper transverse sealing piece 19. Further, vertical sealing pieces 36 mounted, respectively, on the vertical frame members 6 are allowed to lie one on another, as shown in FIG. 3, thereby forming a vertical space 75 together with the above-mentioned vertical AT member 72. This vertical space 75 communicates with hollow portions 6', 6' of the vertical frame 6, 6 via outside air inlet ports 76, 76 formed in the outer plates 33, 33 of the vertical frame members 6, 6.

Figure 4:
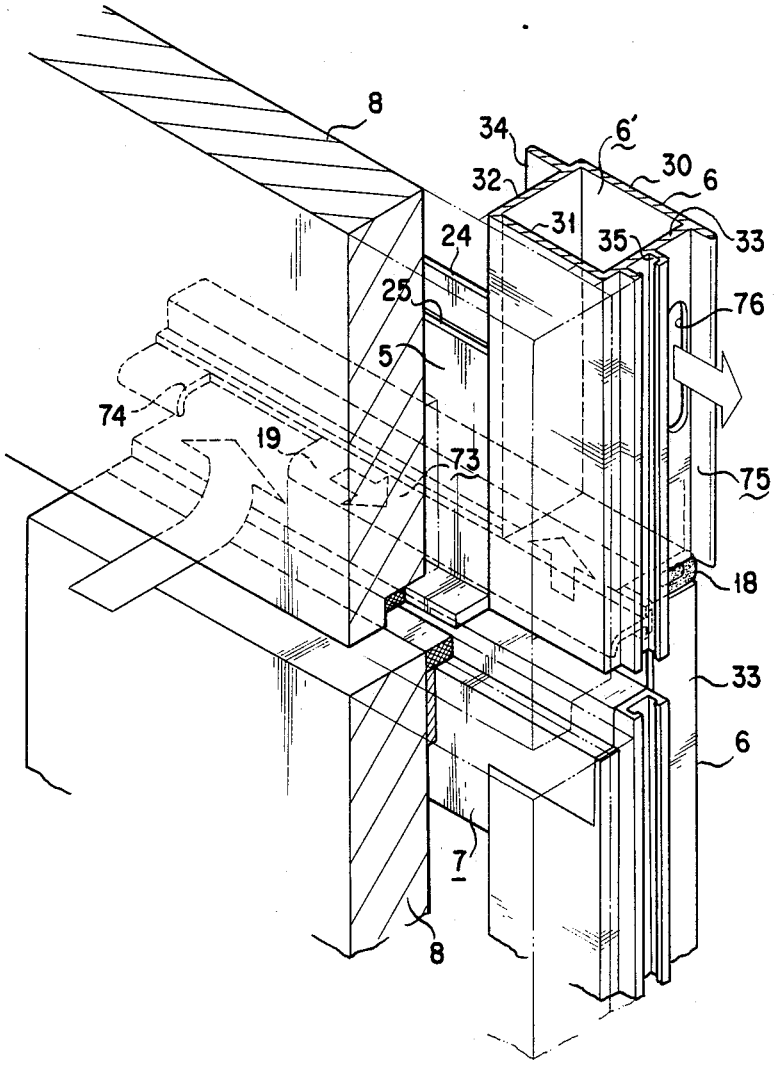
FIG. 4 is a schematic, perspective view showing an open-air inlet portion in the transverse and vertical space of the stone panet unit of the present invention.

Stating in brief, as shown in FIG. 4, the upper transverse AT member 18 is pressed against the lower end surface of the indoor side vertical plate 30 of the vertical frame member 6 and the indoor side lower end surfaces of the inner plate 32 and the outer plate 33, and also the end portion of the upper transverse sealing piece 19 is pressed against the outdoor side inner surface of the outer plate 33 thereby blocking the end portion of the above-mentioned transverse space 73, and further the upper transverse AT member 18 blocks the indoor side of the hollow portion 6' of the vertical frame member 6 thereby allowing the transverse space 73 to communicate with the hollow portion 6' of the vertical frame member 6.

Thus, the upper transverse AT members 18 and the vertical AT member 72 are moutned, on the upper transverse frame member 4 and the mullion member 60, respectively, and the upper transverse AT member 18 and the lower transverse frame member are pressed against with each other by the weight of the stone panel unit 1 located above. Also, the vertical AT member 72 is pressed against the vertical frame member 6 when the stone panel unit 1 is fixedly secured to the mullion member 60 by means of bolts. Tehrefore, when mounting the stone panel units 1 on the external wall of a building, such AT members do not interfere with the mounting work thus improving the construction efficiency and reducing the possibility of creating clearances between the AT members and the frames due to inter-layer displacements and working errors.

Further, since the transverse space 73 and the vertical space 75 are kept at the same pressure as the outside air, the clearance between the above-mentioned upper transverse AT member 18 and the lower transverse frame member 5 and that between the vertical AT member 72 and the vertical frame member 6 can be sealed more satisfactorily.

Further, the hollow portions 6' of the abovementioned vertical frame members 6 are allowed to open through openings, not shown, formed in the inner plates 32 into the space between the stone plates 8 and the reinforcing face plates 50 so that the space can be kept at the same pressure as the outside air, thus preventing the stone plates 8 from being deformed by the pressure of the outside air exerted thereon.

Figure 5:
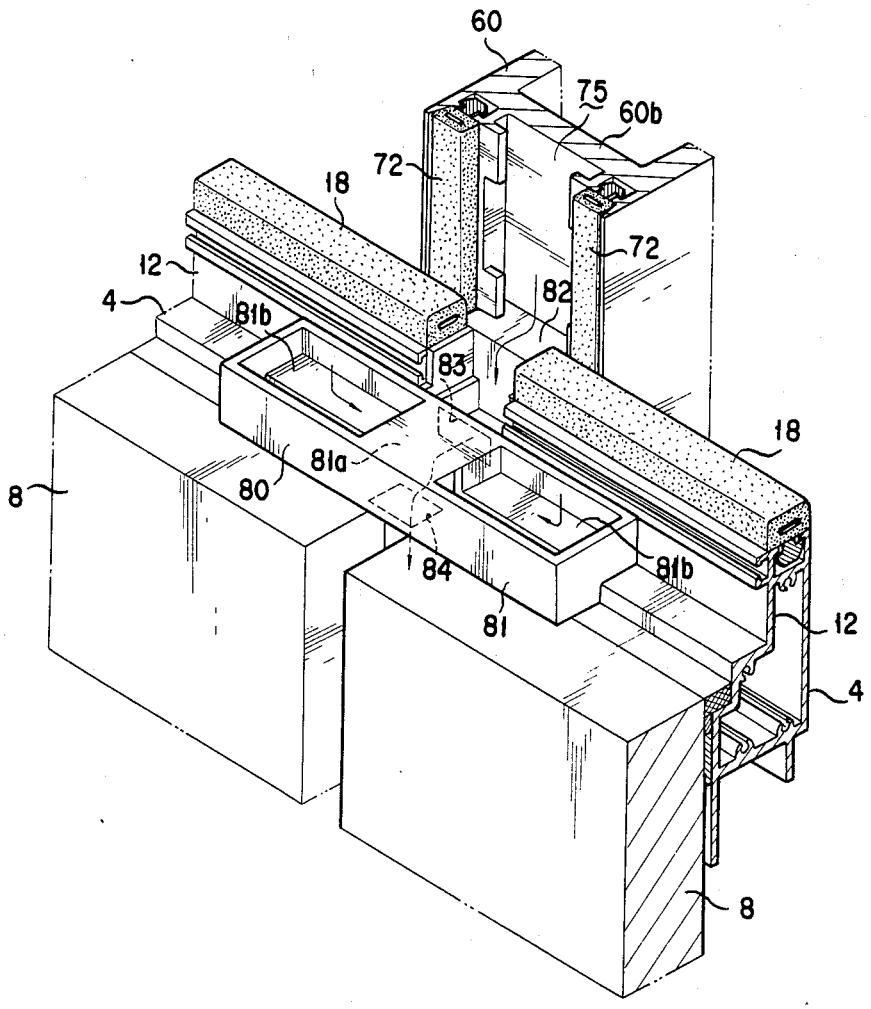
FIG. 5 is a schematic, perspective view showing a drainage portion between the side end of each of one set of adjoining left and right stone panel units and a mullion member erossing it.

Further, as shown in FIG. 5, a catch pan 80 is mounted in the intersecting portion of the upper, lower left and right stone panel units 1.

The catch pan 80 comprises an upwardly open box-shaped body 81 mounted on the upper plates 12, 12 of the left and right upper transverse frame members 4, 4, and a transverse plate 82 kept into contact with the outdoor side wall **60*b* of the mullion member 60. The arrangement is made such that the rain water which has flowed into the vertical space 75 flows along the transverse plate 82 and then through a primary drainage port 83 into a hollow portion 81*a* of the box-shaped body 81, whilst the rain water which has flowed into the hollow portions 6' of the vertical frame members 6 flows into the box-shaped portions 81*b* formed on both side of the box-shaped member 81 and then into the hollow portion 81*a*, and is drained through a secondary drainage port 84 formed in the outer bottom wall of the hollow portion 81*a***.

Figure 6:
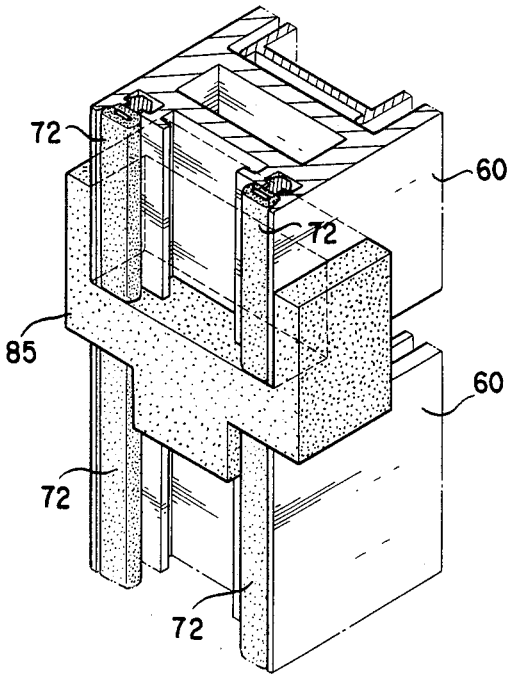
FIG. 6 is a schematic, perspective view showing a connecting portion between one set of vertically adjacent mullion members.

Further, the above-mentioned mullion members 60 are connected at the intermediate portions of the upper and lower stone panel units 1, and as shown in FIG. 6, the adjoining upper and lower longitudinal AT members 72 are connected by a joint packing 85.

It is to be understood that the foregoing description is merely illustrative a preferred embodiment of the present invention, and that the scope of the invention is not to be limited thereto, but is to be determined by the scope of the appended claims.

I claim:

1. A stone panel unit comprising:

a frame formed by connecting, in a rectangular shape, an upper transverse frame member, a lower transverse frame member having an outwardly and horizontally projecting stone panel resting piece formed integrally at a lower end thereof, and one set of left and right vertical frame members spaced away at intervals at a predetermined distance, each of said frame members including a peripheral inner surface;

at least one stone plate adhesively bonded onto an outer surface of said frame so that it may be supported on the frame by allowing a lower end thereof to rest on said stone plate resting piece; and at least one reinforcing face plate mounted on all of said peripheral inner surfaces of said frame members.

2. A stone panel unit as claimed in claim 1, characterized in that it comprises further at least one intermediate transverse frame member which is disposed substantially horizontally by butt-jointing both ends thereof to said one set of left and right vertical frame members, respectively, between said upper transverse frame member and said lower transverse frame member, and which has an outwardly and horizontally projecting stone plate resting piece formed integrally therewith at the approximately intermediate portion of an outdoor side vertical plate, whereby forming a rectangular frame portion by the intermediate transverse frame member, said upper or lower transverse frame member and said one set of the left and transverse frame member and so that a piece of stone plate may be mounted on the frame portion.

3. A stone panel unit mounting structure for mounting stone panels to a building wall, said unit comprising:

a stone panel unit including a frame formed by connecting, in a rectangular shape, an upper transverse frame member, a lower transverse frame member having an outwardly and horizontally projecting stone plate resting piece formed integrally at an lower end thereof, and one set of left and right vertical frame members spaced away at intervals of a predetermined distance; at least one stone plate adhesively boned onto a outer surface of said frame so that it may be supported on the frame by allowing a lower end thereof to rest on said stone plate resting piece; and at least one reinforcing face plate mounted substantially on an entire rear face of said frame;

a plurality of mullion members located transversely on a building at intervals of a predetermined spacing and fixedly secured onto the building wall;

a plurality of upper brackets each having a projection which projects towards an indoor side and in parallel with each of the mullion members, the projection having at least one downward recess formed in an approximately central, lower portion thereof, said upper brackets being fixedly secured to upper parts of the vertical frame members of said stone panel unit by means of a plurality of bolts;

a plurality of supporting rods each engaging with a downward recess of each of said upper brackets in such a manner that, at the time of mounting, said stone panel unit mounted on one set of adjoining mullion members, which are located at intervals of a spacing somewhat wider than said predetermined spacing and each of which projects horizontally and inwardly from each of the mullion members, may be changed in its position in the transverse direction in parallel with the panel surface and in the direction at right angles to the panel surfaces; and a plurality of L-shaped vertically connecting brackets each having one side piece and the other side piece, said one side piece being fixedly secured to a side wall of each of the mullion members by means of a plurality of bolts, said other side piece being fixedly secured to the lower transverse frame member and upper transverse frame member of one set of vertically adjoining stone panel units by means of a plurality of bolts.

4. A stone panel unit mounting structure as claimed in claim 3, characterized in that said stone panel unit comprises further at least one intermediate transverse frame member which is disposed substantially horizontally by butt-jointing both ends thereof to said one set of left and right vertical frame members, respectively, between said upper transverse frame member and said lower frame transverse frame member, and which has an outwardly and horizontally projecting stone plate resting piece formed integrally therewith at the approximately intermediate portion of an outdoor side vertical plate, whereby forming a rectangular frame portion by the intermediate transverse frame member, said upper or lower transverse frame member and said one set of left and right vertical frame members so that a piece of stone plate may be mounted on the frame portion.

* * * * *